US005331909A

United States Patent [19]

Tajima et al.

[11] Patent Number: 5,331,909

[45] Date of Patent: Jul. 26, 1994

[54] PRESSER FOOT AND NEEDLE DRIVE DEVICE IN AN EMBROIDERY MACHINE

[75] Inventors: Ikuo Tajima; Satoru Suzuki; Youichi Mizuguchi, all of Kasugai, Japan

[73] Assignee: Tokai Kogyo Mishin Kabushiki Kaisha, Kasugai, Japan

[21] Appl. No.: 6,972

[22] Filed: Jan. 21, 1993

[30] Foreign Application Priority Data

Jan. 20, 1992 [JP] Japan ..... 4-030196

[51] Int. Cl.[5] ..... D05B 21/00; D05B 29/02

[52] U.S. Cl. ..... 112/103; 112/239; 112/300; 112/121.12

[58] Field of Search ..... 112/121.11, 239, 237, 112/235, 275, 277, 300, 103, 121.12, 221

[56] References Cited

U.S. PATENT DOCUMENTS 4,676,179 6/1987 Nomura et al. ..... 112/239
4,704,978 11/1987 Nomura et al. ..... 112/239 X
5,144,900 9/1992 Takahashi ..... 112/239 X

*Primary Examiner*—Peter Nerbun
*Attorney, Agent, or Firm*—Dennison, Meserole, Pollack & Scheiner

[57] ABSTRACT

A presser foot and needle drive device in an embroidery machine includes a drive mechanism and a control device for vertically reciprocally moving a presser foot between upper and lower dead center. The control device operates the drive mechanism according to patterns of presser foot movements which are determined for specific sewing conditions.

4 Claims, 7 Drawing Sheets

PRESSER FOOT AND NEEDLE DRIVE DEVICE IN AN EMBROIDERY MACHINE

BACKGROUND OF THE INVENTION

1. Field of the Invention

The present invention relates to a presser foot drive device in a sewing machine.

2. Description of the Prior Art

Conventionally, two types of presser foot drive devices have been proposed for vertically reciprocally moving a presser foot in a sewing machine. One type of the devices is constructed to move the presser foot in response to movement of a needle bar, and the other type is constructed to move the presser foot independently of the needle bar. In case of the latter type, the rotation of a main shaft for driving the needle bar and a shuttle is converted into the reciprocal movement of the presser foot by a cam mechanism or a link mechanism.

In the prior art presser foot drive devices, even if they are of the latter type for independently driving the presser foot, the stroke of vertical movement of the presser foot as well as the timing of its vertical movement relative to the movement of the needle bar is substantially fixedly determined by the design of the sewing machine. Thus, the presser foot is moved regardless of the sewing situation or the material of a work fabric. This may produce unpleasant vibrations or noises or may cause breakage of a sewing thread.

SUMMARY OF THE INVENTION

It is, accordingly, an object of the present invention to provide a presser foot drive device in a sewing machine which properly drives a presser foot according to various sewing conditions.

According to the present invention, there is provided a presser foot drive device in a sewing machine, comprising:

- a drive mechanism for vertically reciprocally moving a presser foot; and
- a control device for controlling the drive mechanism according to any of patterns of movement determined for various sewing conditions.

The invention will become more fully apparent from the claims and the description as it proceeds in connection with the drawings.

DETAILED DESCRIPTION OF THE PREFERRED EMBODIMENT

An embodiment of the present invention will now be explained with reference to the accompanying drawings. This embodiment is concerned with a presser foot drive device applied to a multi-head and multi-needle embroidery machine.

Figure 1:
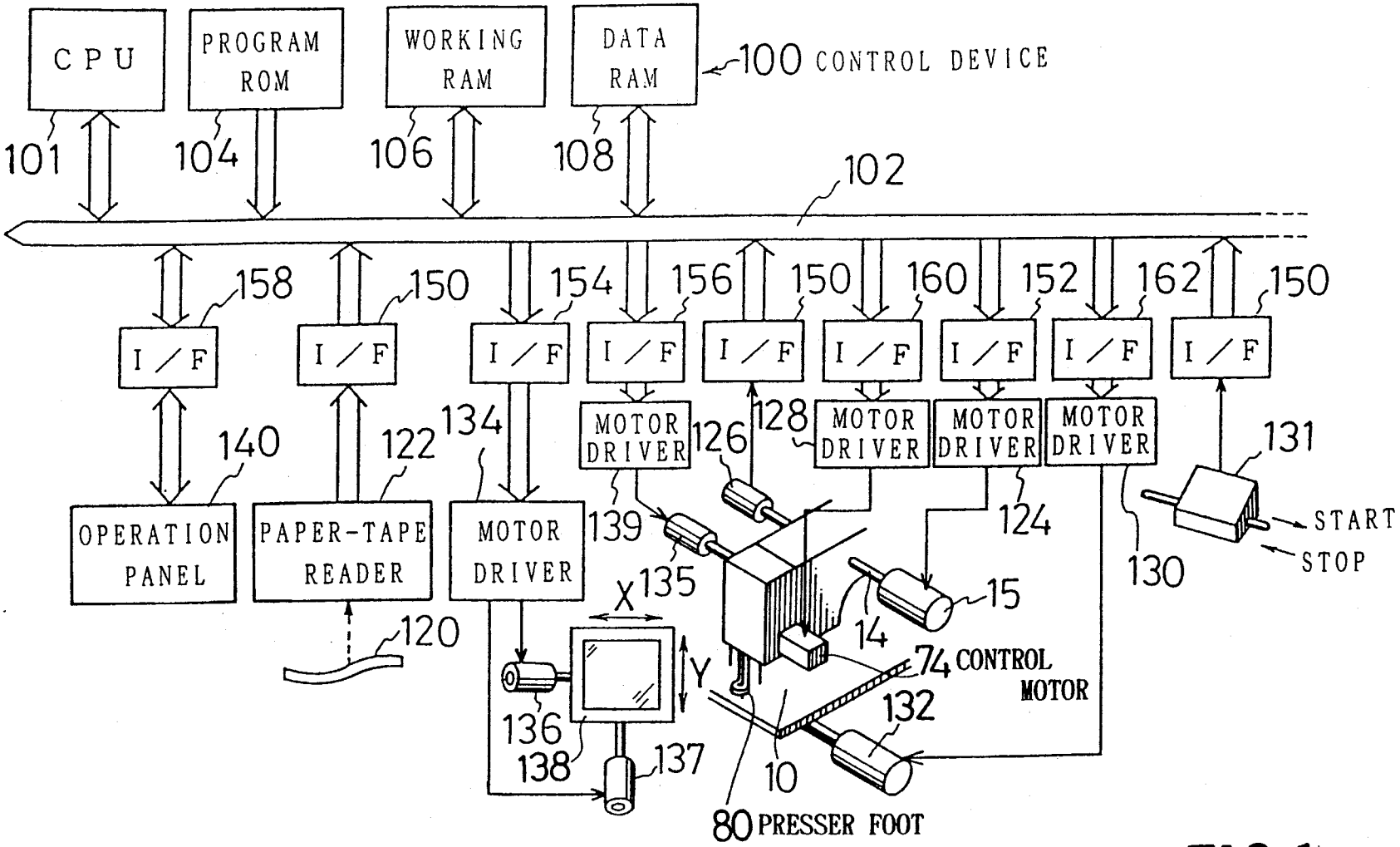
FIG. 1 is a schematic block diagram of a control mechanism of a sewing machine.

Referring to FIG. 1, there is shown a schematic block diagram of various control devices of the embroidery machine. A CPU 101 is a mainstay element of a control device 100 and is connected to a program ROM 104, a working RAM 106 and a data RAM 108, respectively, through a bus line 102.

An interface 150 is connected to the CPU 101 through the bus line 102. The interface 150 serves to convert a data signal from a paper-tape reader 122 which reads out data of an embroidery pattern written in a paper tape 120, an output signal from an encoder 126 which detects the rotational angle of a main shaft 14 and an on-off signal from a sewing start switch 131 which is operated by an operator, into corresponding signals which are appropriate for inputting to the CPU 101, respectively.

An interface 152 outputs a control signal for a motor driver 124 of a main shaft motor 15 which drives the main shaft 14. An interface 154 outputs a control signal for a motor driver 134 of embroidery frame drive motors 136 and 137. An interface 156 outputs a control signal for a motor driver 139 of a color change motor 135 which slidably moves a needle bar case 50. An interface 160 outputs a control signal for a motor driver 128 of a pulse motor 74 which drives a presser foot 80. An interface 162 outputs a control signal for a motor driver 130 of a shuttle drive motor 132. These interfaces 152, 154, 156, 160 and 162 are also connected to the CPU 102 through the bus line 102.

An operation panel 140 is equipped with various operation keys and indicators. An interface 158 of the operation panel 140 is also connected to the CPU 101 through the bus line 102.

Figure 2:
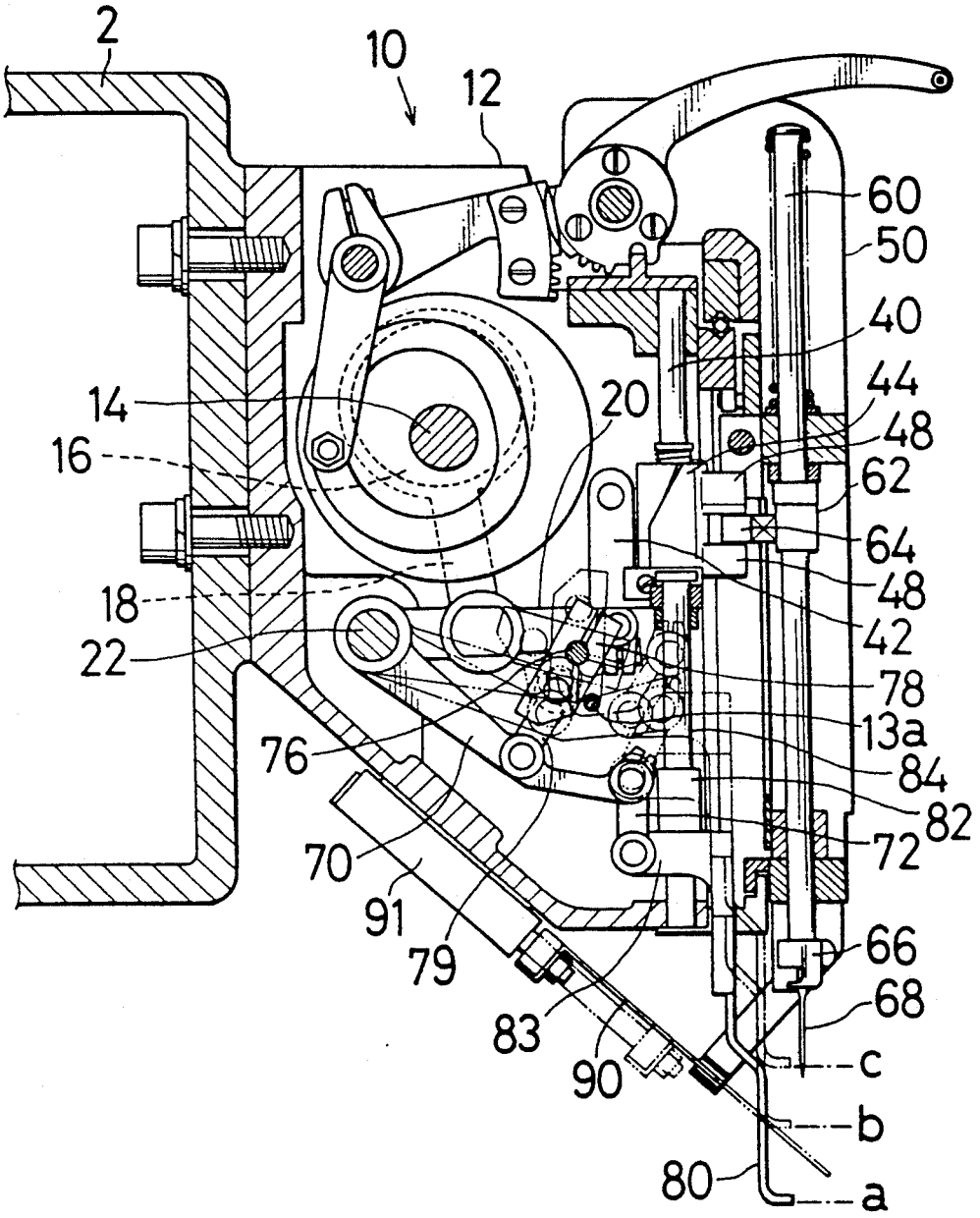
FIG. 2 is a sectional side view of a sewing head.
Figure 3:
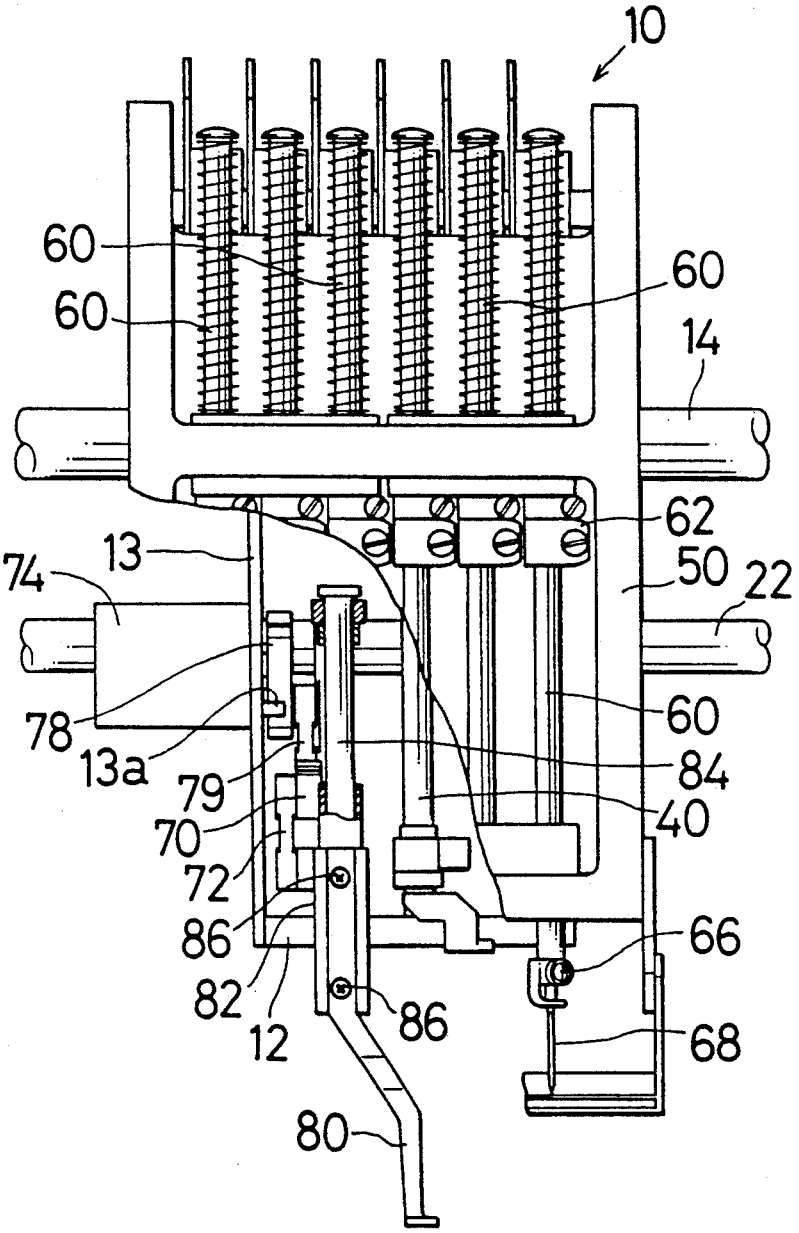
FIG. 3 is a front view, with a part broken away, of the sewing head.

Referring to FIGS. 2 and 3, a sewing head 10 is shown in sectional side view and front view, respectively. The sewing head 10 includes a machine arm 12 fixed to a machine frame 2. A main shaft 14 is continuously driven by a main shaft motor 15 and extends through the machine arm 12. A needle bar drive cam 16 is fixed to the main shaft 14.

A base needle bar 40 is disposed on the front side of the machine arm 12. A drive base 42 is mounted on the base needle bar 40 and is slidably movable together with a needle bar drive member 44 along the base needle bar 40 in a vertical direction. The needle bar drive member 44 includes a pair of engaging protrusions 48 disposed in a vertical direction relative to each other on the front side of the machine arm 12.

The rotation of the needle bar drive cam 16 is transmitted to a needle bar drive lever 20 through a connecting rod 18. One end of the needle bar drive lever 20 is pivotally supported by a support shaft 22 fixed to a part of the machine arm 12. The needle bar drive lever 20 is pivoted around the support shaft 22 in response to rotation of the needle bar drive cam 16, so that the drive base 42 is moved vertically together with the needle bar drive member 44 along the base needle bar 40.

A guide shaft 84 is disposed on the machine arm 12 at a position adjacent the base needle bar 40 and extends parallel therewith. A slide member 82 is vertically movably mounted on the guide shaft 84. The presser foot 80 is fixed to the slide member 82 and is moved together with the slide member 82. The presser foot 80 is fixed to the slide member 82 through a pair of screws 86 and the position of the presser foot 80 is adjustable relative to the slide member 82.

A presser foot drive lever 70 is disposed rearwardly of the guide shaft 84. One end of the presser foot drive lever 70 is pivotally supported by the support shaft 22 which supports the needle bar drive lever 20. The other end of the presser foot drive lever 70 is connected to an arm 83 formed on the rear side of the slide member 82 through a link member 72. Thus, as the presser foot drive lever 70 is pivoted around the support shaft 22, the slide member 82 is vertically moved together with the presser foot 80 along the guide shaft 84 through the link member 72.

The pulse motor 74 for driving the presser foot 80 is mounted on a side wall 13 of the machine arm 12. A link mechanism including link members 78 and 79 connects a motor shaft 76 of the pulse motor 74 to the middle portion of the presser foot drive lever 70. As the pulse motor 74 is driven to rotate the motor shaft 76 under control, the presser foot drive lever 70 is pivoted around the support shaft 22 through the link mechanism, so that the presser foot 80 is reciprocally vertically moved.

The link member 78 connected to the motor shaft 76 of the pulse motor 74 is biased by a spring (not shown) toward a stopper 13*a* fixed to the side wall 13. Although such a spring is normally not required, it may serve to recover the pulse motor 74 from out-of-control condition in case that the pulse motor 74 is driven under opened loop control and that the pulse motor 74 is out of control because of an excessive load. Thus, even if the pulse motor 74 has become out of control, the link member 78 can be returned to a position shown by a solid line in FIG. 2 by the biasing force of the spring when the supply of power to the pulse motor 74 is stopped for each cycle of vertical movement of the presser foot 80.

A needle bar case 50 is mounted on the front side of the machine arm 12. The needle bar case 50 is slidably movable in a lateral direction of the sewing head 10 under control of the color change motor 135. A plurality of needle bars 60 are vertically movably mounted on the needle bar case 50 and are disposed along the direction of sliding movement of the needle bar case 50. A needle bar holder 62 is fixed to each needle bar 60 and includes a pin 64 engageable with the engaging protrusions 48 of the needle bar drive member 44. A sewing needle 68 is mounted on the lower end of each needle bar 60 through a needle stopper 66.

When the color change motor 135 is driven under control to move the needle bar case 50 relative to the machine arm 12, the pin 64 of selected one of the needle bars 60 engages the engaging protrusions 48 of the needle bar drive member 44. Consequently, the selected one of the needle bars 60 is moved vertically together with its associated sewing needle 68 in response to vertical movement of the needle bar drive member 44.

A sewing operation of the above embroidery machine will now be explained in brief. As the main shaft drive motor 15 is driven to rotate the main shaft 14, the needle bar drive member 44 is reciprocally vertically moved in response to the rotation of the main shaft 14, so that the selected one of the needle bars 60 is reciprocally vertically moved. Synchronously therewith, the pulse motor 74 and the shuttle drive motor 132 are driven under control so as to drive the presser foot 80 and a shuttle (not shown), respectively. Further, simultaneously with these operations, an embroidery frame 138 shown in FIG. 1 is moved based on the signal from the embroidery control device 100 under control with respect to X and Y directions. Consequently, a work fabric is embroidered by a predetermined figure.

Under control of the pulse motor 74, the presser foot 80 is synchronously moved, in response to the vertical movement of the needle bar 60, normally between an upper dead center a and a lower dead center b shown by a solid line and a dotted line in FIG. 2, respectively. However, for an operation for cutting an upper thread (not shown), the presser foot 80 can escape to another upper dead center c.

After the operation for cutting the upper thread (hereinafter called "thread cutting operation") has been finished, an upper thread hook member 90 is moved by an actuator 92 from a position shown by a solid line in FIG. 2 to a position shown by a dotted line so as to engage an upper thread. The hook member 90 is thereafter returns to the position show by the solid line to retain one end of the upper thread. During this operation, the presser foot 80 escapes to the upper dead center c, so that any interference between the presser foot 80 and the hook member 90 can be eliminated and any working operation which may be performed at a position below the sewing needle 68 after the cutting operation can be easily made.

When the color change motor 17 is moved under control based on the color change signal from the embroidery control device 100, the needle bar case 50 is slidably moved along the front side of the machine arm 12 so as to newly select the needle bar 60 which is vertically driven by the needle bar drive member 44.

The drive control of the presser foot 80 will now be explained with reference to FIGS. 4 to 6 which show various patterns of movement of the selected needle bar 60 and the presser foot 80 with respect to the rotational angle of the main shaft 14 in various sewing situations.

The pattern shown in FIG. 4 (hereinafter called Pattern A) is applied for normal sewing operation. In this Pattern A, the presser foot 80 is moved between the lower dead center a and the upper dead center b, and the stroke of this movement is determined to have a length considerably shorter than that of the conventional embroidery machine.

Further, in this Pattern A, the movement of the presser foot 80 relative to the movement of the needle bar 60 is determined in such a manner that the presser foot 80 reaches the lower dead center a before sticking of the sewing needle 68 into the work fabric and that it starts to move upwardly after the sewing needle 68 has been completely moved away from the work fabric, so that the sewing operation can be properly performed without any trouble such as breakage of the thread.

Figure 4:
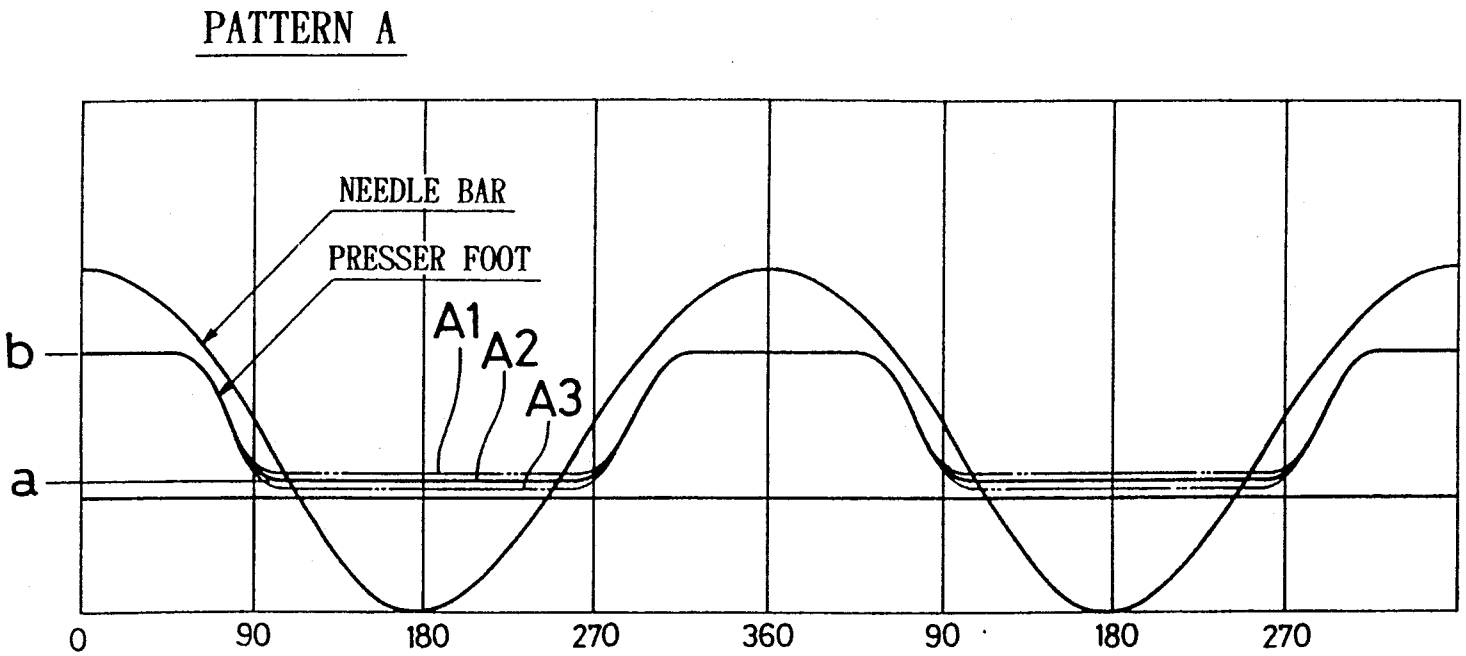
FIG. 4 is a graph showing operation timings, for a normal sewing operation, of a needle bar and a presser foot with respect to the rotational angle of a main shaft of the sewing machine;.

As for the Pattern A, the lower dead center a of the presser foot 80 may have any one of three positions "HIGH", "MIDDLE" and "LOW" as indicated by lines A1, A2 and A3 in FIG. 4, respectively. According to the thickness of the work fabric to be sewn, the operator can select any one of the lines A1, A2 and A3 by operation of keys of the operation panel 140 before starting the sewing operation.

Figure 5:
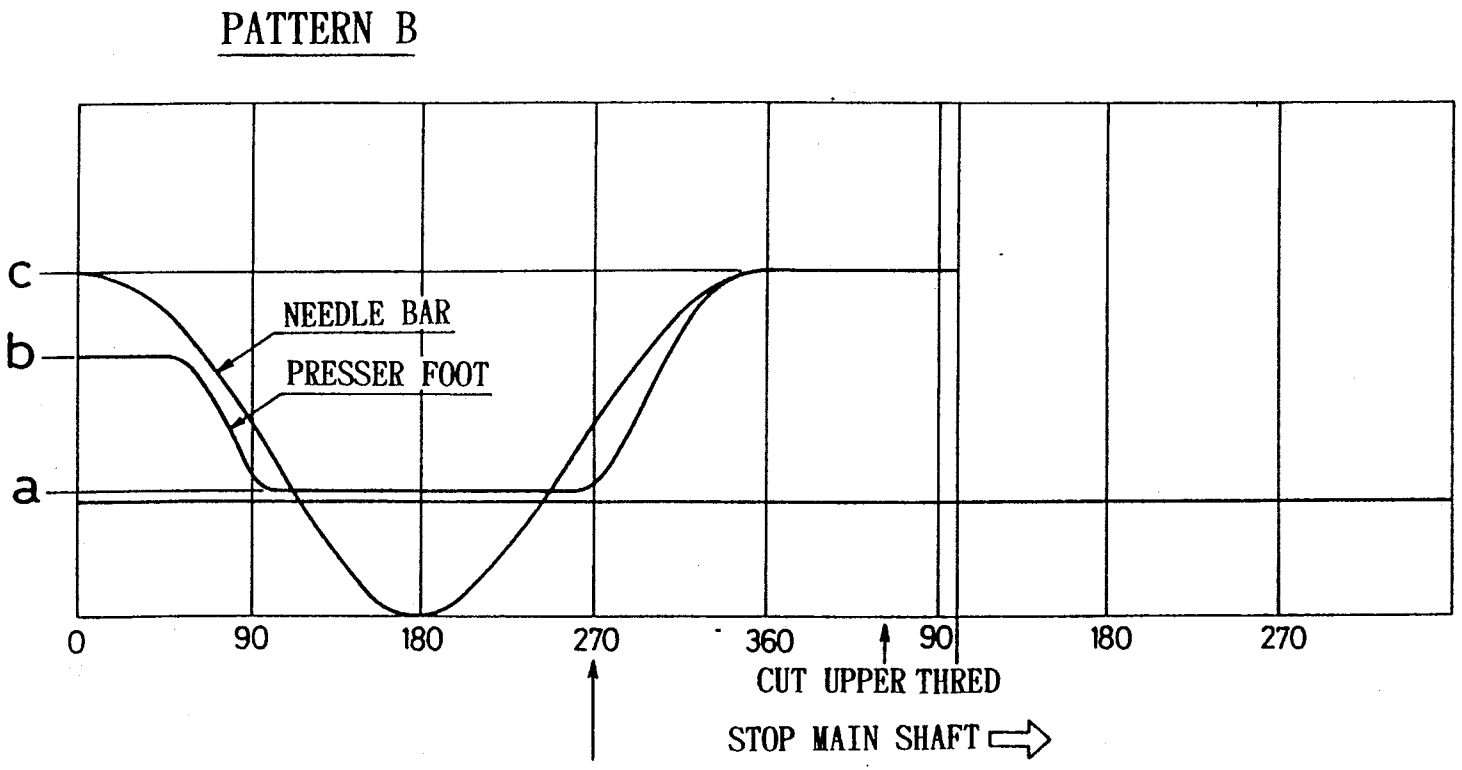
FIG. 5 is a graph showing operation timings, for a thread cutting operation, of the needle bar and the presser foot with respect to the rotational angle of the main shaft.

The pattern for the thread cutting operation (hereinafter called Pattern B) is shown in FIG. 5. In this Pattern B, a jumping signal is turned on when the main shaft 14 is rotated substantially at an angle of 270° (immediately after the needle bar 60 has started to be moved upwardly). Thus, the engaging protrusions 48 of the needle bar drive member 44 are disengaged from the pin 64 immediately before the needle bar 60 reaches the upper dead center, so that the needle bar 60 can be kept at the upper dead center.

Further, in this Pattern B, the presser foot 80 is moved upwardly to reach the upper dead center c for escapement based on the thread cutting signal inputted to the control device 100 and is kept at the upper dead center c. The upper thread is thereafter cut and the rotation of the main shaft 14 is subsequently stopped.

Figure 6:
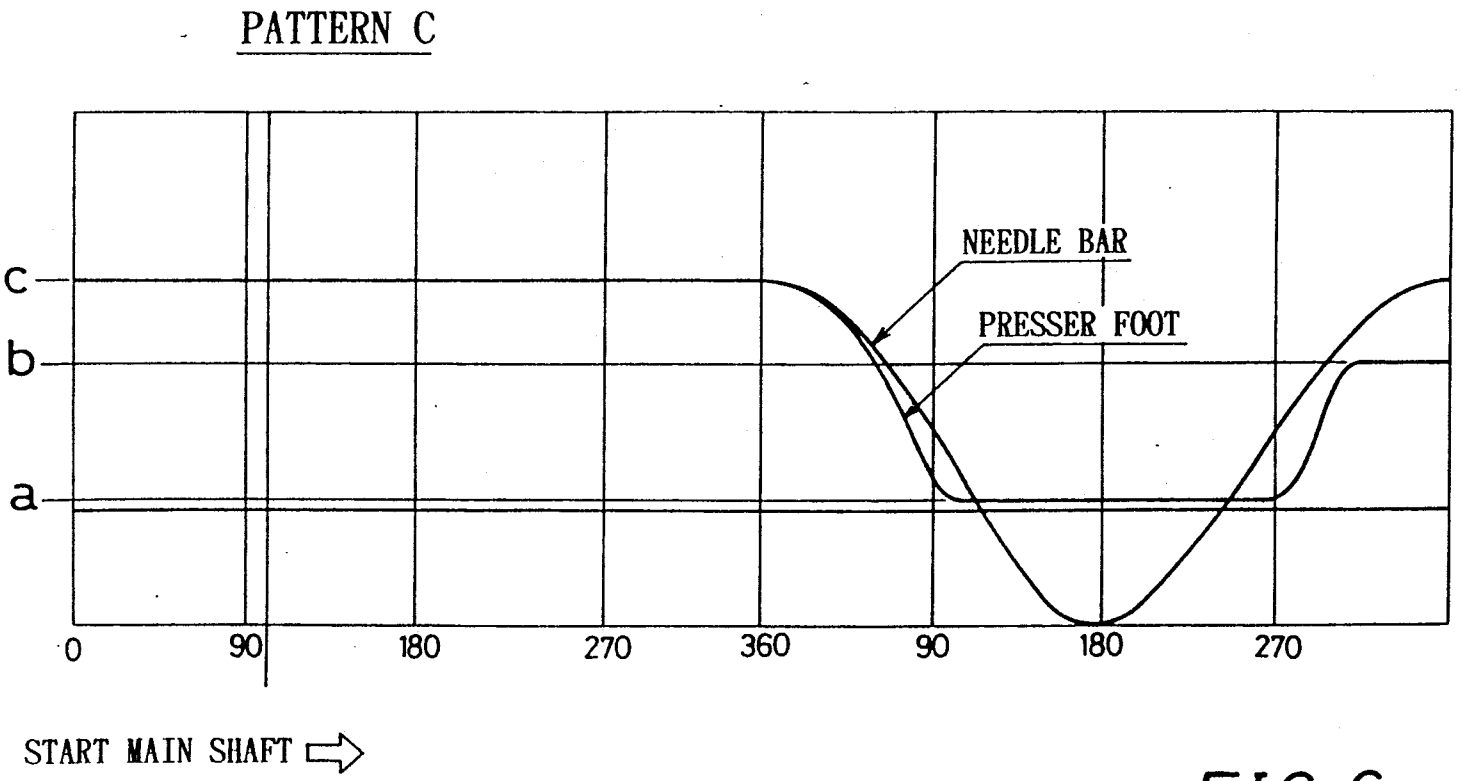
FIG. 6 is a graph showing operation timings, for a sewing start operation, of the needle bar and the presser foot with respect to the rotational angle of the main shaft.

The pattern for the sewing start operation (hereinafter called Pattern C) is shown in FIG. 6. In this Pattern C, as the main shaft 14 is started to be driven based on the sewing start signal produced by the operation of the start switch 131 shown in FIG. 1, the needle bar 60 kept at the upper dead center is started to be moved downwardly. Synchronously therewith, the presser foot 80 kept at the upper dead center c is started to be moved downwardly to reach the lower dead center a. After one stitch has been sewn, the pattern C is changed to return to the Pattern A.

Figure 7:
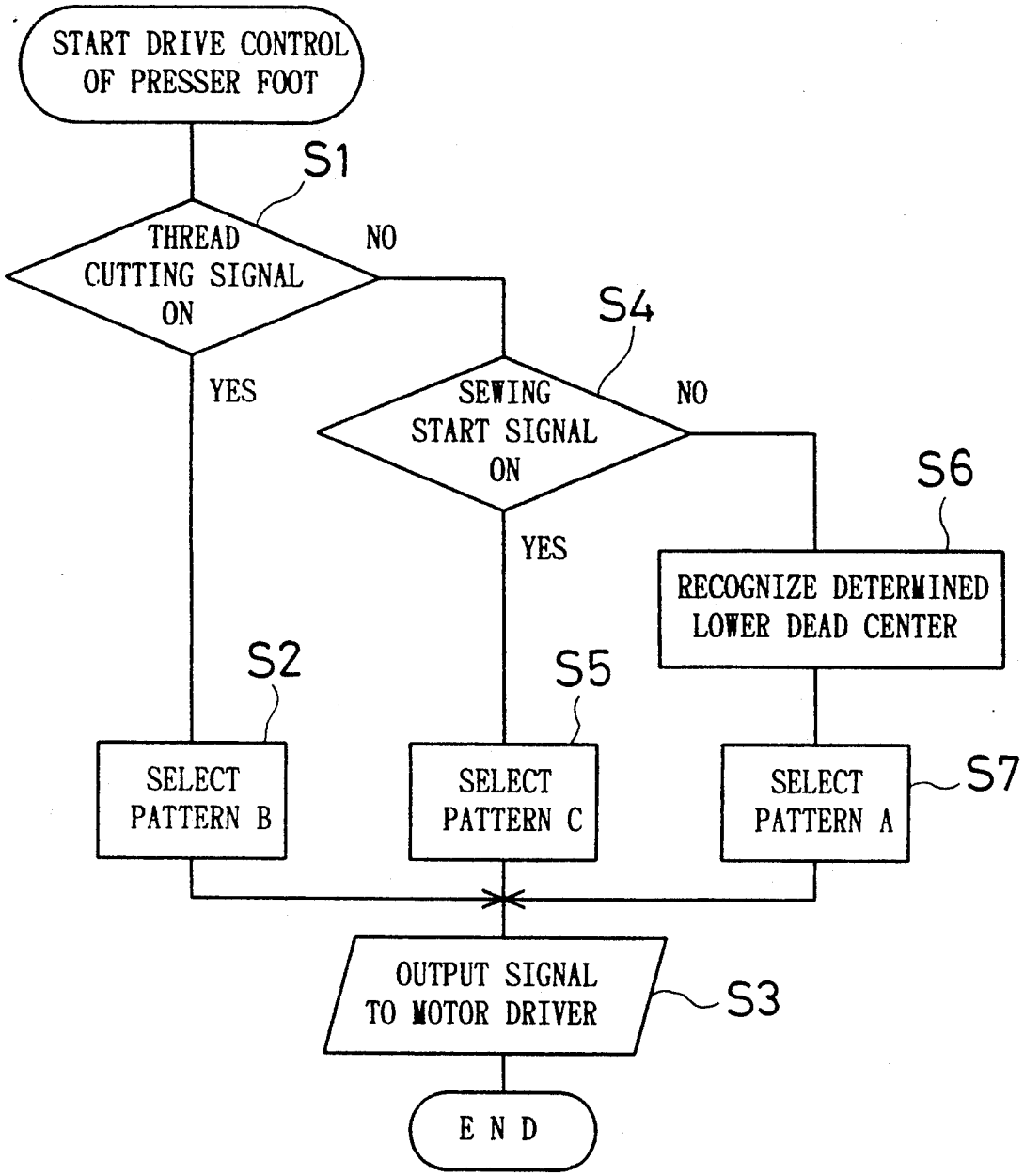
FIG. 7 is a flowchart showing process of control for movement of the presser foot.

Finally, the drive control of the presser foot 60 by the CPU 101 of the embroidery control device 100 will now be explained with reference to a flowchart shown in FIG. 7. Firstly, in Step S1, the CPU 101 determines as to whether the thread cutting signal is on or off. If the thread cutting signal is on, the process proceeds to Step S2 to select the Pattern B shown in FIG. 5. Subsequently, a command signal corresponding to the Pattern B is outputted to the motor driver 128 of the pulse motor 74, and the process is finished.

If the thread cutting signal is off in Step S1, the process proceeds to Step S4 to determine as to whether the sewing start signal is on or off. If the sewing start signal is on, the process proceeds to Step S5 to select the Pattern C shown in FIG. 6. Subsequently, a command signal corresponding to the Pattern C is outputted to the motor driver 128 in Step S3, and the process is finished.

If the sewing start signal is off in Step S4, the process proceeds to Step S6 to recognize the lower dead center a as to which line is set among lines A1, A2 and A3. The process thereafter proceeds to Step S7 to select the Pattern A based on the set line for the lower dead center a. The process further proceeds to Step S3 to output a command signal corresponding to the Pattern A to the motor driver 126. The process is then finished.

Thus, with this embodiment, the stroke of movement of the presser foot 80 as well as the timing of movement of the presser foot 80 relative to the movement of the needle bar 60 can be changed according to various sewing conditions. Therefore, unpleasant vibrations or noises during the sewing operation can be reduced and the stitches can be formed in proper forms.

While the invention has been described with reference to a preferred embodiment, it is to be understood that modifications or variation may be easily made without departing from the spirit of this invention which is defined by the appended claims.

What is claimed is:

1. A presser foot and needle drive device in an embroidery machine for moving the presser foot in response to the vertical reciprocating movement of a needle bar and sewing needle, comprising:

drive means for vertically reciprocally moving a presser foot; and control means operable for controlling said drive means to effect patterns of movement of said presser foot for various sewing conditions; means to effect plural strokes of vertical reciprocating movement of said needle bar;

said control means operating to determine a pattern of vertical movement of the presser foot with respect to each stroke of vertical reciprocating movement of a needle bar based on a sewing start command signal and a thread cutting command signal, said control means controlling said drive means to effect said determined pattern.

2. The presser foot device as defined in claim 1 wherein said patterns include a first pattern for normal sewing operation, and said first pattern operates so that the pressure foot is moved from an upper dead center to a lower dead center before a sewing needle mounted on the needle bar is stuck into the work fabric, and the presser foot is moved from the lower dead center to the upper dead center after the sewing needle has been completely moved away from the work fabric.

3. The presser foot device as defied in claim 2 wherein said control means operates to change the position of the lower dead center of said presser foot in said first pattern for normal operation according to change of thickness of a work fabric.

4. The presser foot drive device as defined in claim 2 wherein said patterns include a second pattern for a thread cutting operation, said second pattern operates so that the presser foot is held at the upper dead center, the position of which is higher than the upper dead center for said first pattern.

* * * * *